US005365242A

United States Patent [19]

Shiina

[11] Patent Number: 5,365,242

[45] Date of Patent: Nov. 15, 1994

[54] GLASS ANTENNA FOR A TELEPHONE OF AN AUTOMOBILE

[75] Inventor: Masaru Shiina, Kanagawa, Japan

[73] Assignee: Asahi Glass Company Ltd., Tokyo, Japan

[21] Appl. No.: 110,948

[22] Filed: Aug. 24, 1993

Related U.S. Application Data

[63] Continuation of Ser. No. 928,175, Aug. 14, 1992, Pat. No. 5,264,858, which is a continuation of Ser. No. 733,817, Jul. 22, 1991, abandoned.

[30] Foreign Application Priority Data

Jul. 31, 1990 [JP] Japan ..... 2-80622

[51] Int. Cl.[5] ..... H01Q 1/32; H01Q 1/38

[52] U.S. Cl. ..... 343/713; 343/829; 343/873

[58] Field of Search ..... 343/704, 711–715, 343/829, 845, 846, 848, 795, 807, 873

[56] References Cited

U.S. PATENT DOCUMENTS 5,049,892 9/1991 Lindenmeier et al. ..... 343/713

FOREIGN PATENT DOCUMENTS 0043905 2/1987 Japan ..... 343/713
8809569 12/1988 WIPO ..... 343/713

*Primary Examiner*—Rolf Hille
*Assistant Examiner*—Peter Toby Brown
*Attorney, Agent, or Firm*—Oblon, Spivak, McClelland, Maier & Neustadt

[57] ABSTRACT

A glass antenna for a telephone of an automobile which comprises a main antenna conductor composed of a plurality of conductive strips extended radially from a junction, the outline shape of which is substantially a triangle or a sector. An insular earth conductor is disposed opposing the junction of the main antenna conductor and is disconnected with the main antenna conductor with respect to direct current. Power feeding terminals are provided on the main antenna conductor and the insular earth conductor and at least one set of the main antenna conductor and the insular earth conductor are formed at a predetermined position of a glass plate.

10 Claims, 6 Drawing Sheets

GLASS ANTENNA FOR A TELEPHONE OF AN AUTOMOBILE

This is a continuation of application Ser. No. 07/928,175, filed on Aug. 14, 1992, and now U.S. Pat. No. 5,264,858 which is a continuation of application Ser. No. 07/733,817, filed on Jul. 22, 1991 and now abandoned.

BACKGROUND OF THE INVENTION

1. Field of the Invention

The present invention relates to a glass antenna for a telephone of an automobile suitable for using a radiowave having a frequency band of about 800 MHz to 1 GHz.

2. Discussion of Background

In recent times, there are many cases in which a telephone is mounted on an automobile to enable communication from inside the automobile while it is moving.

The radiowave utilized in such automobile telephone pertains to the frequency band of 820 to 940 MHz. As an antenna for transmitting and receiving the radiowave, a pole antenna is conventionally utilized.

As for such pole antenna, it is possible to obtain a sufficient practical performance as an antenna. However, conventionally, the pole antenna is utilized in the form of a stick-like protrusion which is protruded from a mounting surface of a car body. Therefore, the pole antenna, as a protrusion, generates unpleasant wind shearing sound in running, or is complicated in appearance, and makes a bad impression. Moreover, it may be injurious to a person, and may get a mischief in parking the car.

SUMMARY OF THE INVENTION

It is an object of the present invention to provide a glass antenna for a telephone of an automobile capable of obtaining a practical antenna gain equivalent with the pole antenna, by providing an antenna conductor having a predetermined pattern on a glass plate such as a rear glass or a side glass or a front glass, in view of the above problem found in the conventional pole antenna.

According to an aspect of the present invention, there is provided a glass antenna for a telephone of an automobile which comprises: a main antenna conductor composed of a plurality of conductive strips extended radially from an apex, the outline shape of which is substantially a triangle or a sector; an insular earth conductor disposed opposing the apex of the main antenna conductor and disconnected with the main antenna conductor with respect to direct current; and power feeding terminals provided on the main antenna conductor and the insular earth conductor: at least one set of the main antenna conductor and the insular earth conductor being formed at a predetermined position of a glass plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given to the present invention based on the drawings, as follows.

For a glass plate which is fitted in window frames at pertinent positions, such as a rear glass or a side glass of an automobile, as an antenna element for an automobile telephone, an antenna conductor is provided having a pertinent pattern which is excellent in the antenna gain with respect to the radiowave having a frequency band of mainly about 820 to 940 MHz.

Figure 1:
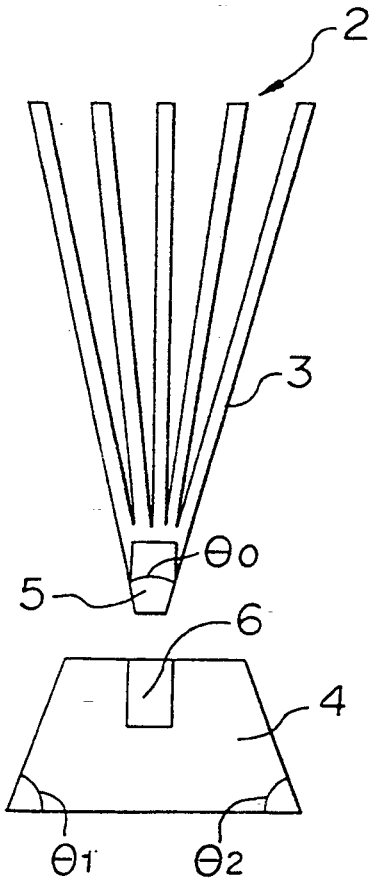
FIG. 1 is a front view showing an embodiment of an antenna conductor according to the present invention.

FIG. 1 is a front view showing a representative pattern of the antenna conductor of the glass antenna for a telephone of an automobile according to the present invention. In FIG. 1, the main antenna conductor 2 is provided, comprising of a plurality (5 in FIG. 1) of the conductor strips 3 which are radially extended from junction and an outline shape of which constitutes substantially a triangle, and on which the power feeding point 5 is formed on the above junction portion. On the lower side of the power feeding point 5 of the main antenna conductor 2, the trapezoidal earth conductor 4, an insular earth conductor, opposing the main antenna conductor 2, interposing a space therebetween, is provided.

The power feeding point 5 for signals, is provided on the main antenna conductor 2, and the power feeding point 6 for earth, is provided on the earth conductor 4.

The receiving signal excited in the main antenna conductor 2, is transmitted to a receiver from the power feeding point 5 through a signal cable.

An earth terminal of the receiver is connected to the power feeding point 6 by a cable for earth.

$\theta_1$ and $\theta_2$ are angles made between the base of the trapezoidal earth conductor 4 and the sides thereof.

Furthermore, the insular earth conductor 4 is coupled with a car body in capacitive coupling, for promoting the antenna performance, which constitutes a good earth. A trapezoid is preferred for a suitable impedance characteristic thereof, in the whole range of the necessary frequency band.

When the earth conductor 4 is provided adjacent to the four corners of the plate glass, a shape is desirable which is fitted to the shape of the four corners of the plate glass, such as a quadrilateral shape or a shape having rounded corners.

The area of the earth conductor 4 is desirable to be from 2 $cm^2$ to 20 $cm^2$, to obtain a sufficient coupled capacitance with a car body, since it promotes the antenna performance.

The distance between the earth conductor 4 and the car body is ordinarily desirable to be 0.2 mm to 3 cm, although it may vary with a mounting angle of the glass to the car body, and particularly 2 mm to 1 cm for further promotion of the antenna performance.

In case that the shape of the earth conductor 4 is a trapezoid, the lengths of the sides adjacent to the car body can be modified by $\theta_1$ and $\theta_2$. When the antenna is utilized in the band width of 820 to 940 MHz, $\theta_1$ and $\theta_2$ are suitable in 45° to 85°, and the preferable range thereof is 60° to 80°.

The distance between the main antenna conductor 2 and the earth conductor 4 is desirable to be 0.5 to 10 mm. When the distance is out of the above range, an impedance mismatching is generated between a transmitting system and a receiving system formed by the main antenna conductor 2 or the like, which is not desirable with respect to the receiving characteristic.

A more preferable range thereof is 1 to 5 mm.

The opening degree $\theta_0$ of the conductor strips 3 is desirable to be 5° to 150°.

When the opening degree is out of the above range, the above impedance mismatching is generated.

A more preferable range of $\theta_0$ is 10° to 90°, and a particularly desirable range of $\theta_0$ is 15° to 45°.

The lengths of the respective conductor strips 3 are desirable to be shorter than one fourth of the wavelength in the utilizing frequency band, by 30%, in view of the receiving characteristics. For instance, when the utilizing frequency falls in the range of 820 to 940 MHz, the lengths of the respective conductor strips 3 are desirable to be 50 to 70 mm. However, they may be utilized even when their lengths are out of the above specified range.

Furthermore, by differentiating the respective lengths of the respective conductor strips 3, a radiowave having different frequencies can uniformly be received.

The width of the respective conductor strips 3 is desirable to be 0.5 to 2 mm, and the number of the conductor strips 3 is 3 to 10, considering both aspects of the receiving characteristic and insuring of a field of vision.

Furthermore, as a totally different embodiment, the main antenna conductor 2 is not composed of the several conductor strips 3, but may be composed of a planar conductor pattern such as a triangle, and a sector.

In this case, the planar main antenna conductor 2 is not limited to the shape of a triangle or the like, but may be a diamond, or a triangle or a sector or a diamond having rounded corners.

The power feeding point 5 may be provided at any position on the main antenna conductor 2. However it is desirable to provide the power feeding point 5 on the junction of the main antenna conductor 2, in view of the receiving characteristic.

Furthermore when a defogger for preventing fogging is provided on a glass plate, the distance between the defogger and the main antenna conductor 2 is desirable to be more than 2 cm. This is for preventing the lowering of the receiving characteristic by the influence of the defogger.

In this invention, when the glass plate is composed of a laminated glass, the conductor strips may be provided on a surface of respective glasses at the joining surface thereof, or may be disposed at the innermost surface or the outermost surface of the laminated glass. When the glass is a toughness glass having a single plate structure, the conductor strip 3 may be provided at the innermost surface or the outermost surface of the toughness glass.

In the antenna conductor in this invention, a pattern may be utilized in which the above pattern is rotated by 90° or by a predetermined angle, by which the main antenna conductor 2 is disposed in the horizontal direction. Moreover, by increasing the number of radial strips the gain and the directivity of the antenna can be improved.

Figure 2:
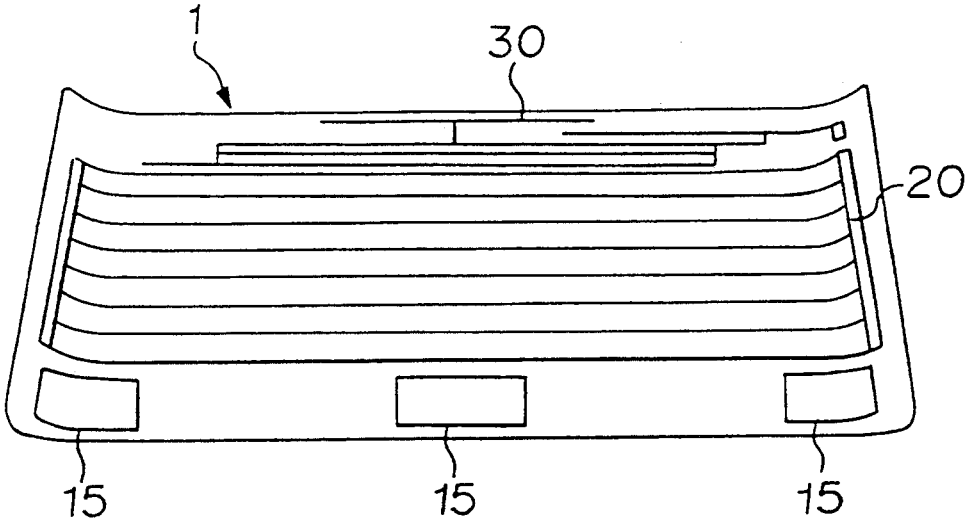
FIG. 2 is a front view of a glass plate for a rear window of an automobile showing the position of the antenna conductor according to the present invention.

FIG. 2 is a front view of the glass plate 1 for a rear window of an automobile, showing an embodiment in which the position of the antenna conductor according to the present invention is shown. In FIG. 2, a reference numeral 30 designates an antenna conductor for AM, FM or the like, 20, a defogger, and 15, examples of portions of the window on which the antenna conductor of the present invention is formed. In FIG. 2, an example is shown in which on the glass plate 1 as the rear glass of an automobile on which the defogger 20 or the other antenna conductor 30 for AM/FM are provided, the forming domain 15 of the antenna conductor is provided at left or right or the center of the glass plate 1, on the downward side thereof. The forming position of the antenna conductor, and the number of shapes of the antenna conductor may suitably be selected in view of the antenna gain. Furthermore it is possible to provide the antenna conductor at a suitable portion of a window glass, such as at a side glass as well as the rear glass.

Moreover in this invention, the antenna conductor 2 formed on the surface of the glass plate 1 may be produced by using suitable conductive strip materials such as conductive strips or conductive metal foils such as copper foils which are formed by printing a conductive paste in a predetermined pattern which is formed by mixing a conductive powder such as Ag or Al or Pd with a glass powder, and with a binder or the other necessary additives, and by curing thereof.

EXAMPLES

Explanation will be given to examples referring to the drawings.

Example 1

Figure 3:
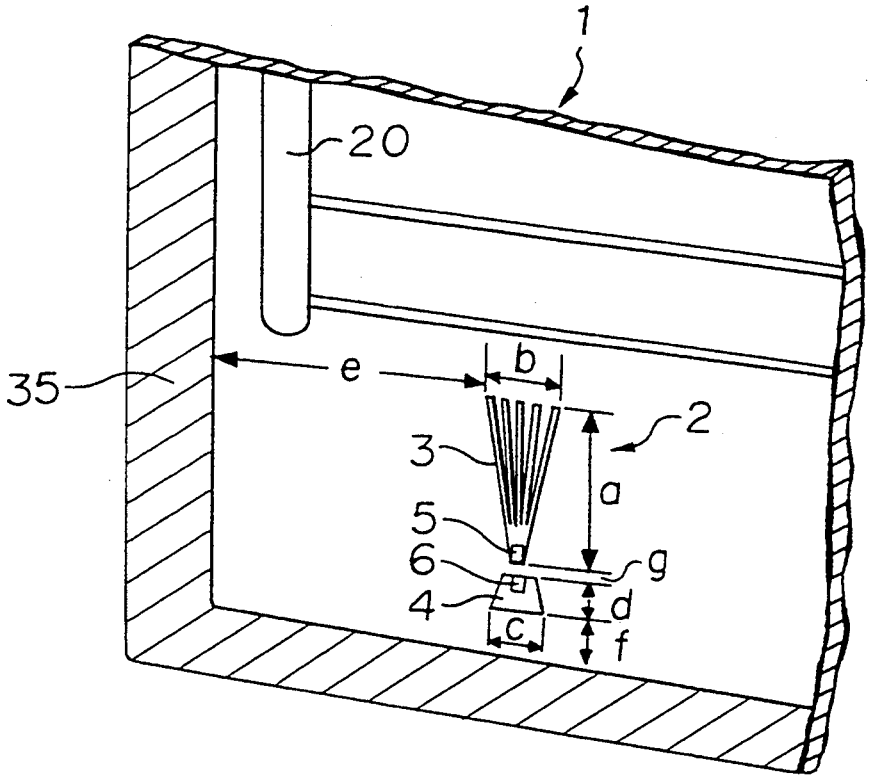
FIG. 3 is a partial perspective of a glass plate surface on which the antenna conductor is formed, according to Embodiment 1.

FIG. 3 is a partial perspective view of an Example according to the present invention, showing the respective dimensions of the antenna conductor which is formed on the surface of the glass. The antenna conductor has a pattern shown in FIG. 1, which is produced by printing the conductive paste on the glass plate and by curing it. The dimensions of respective parts are shown as below. In FIG. 3, the surfaces of the respective antenna conductors are plated. In FIG. 3, a reference numeral 35 designates a covering portion which surrounds the glass plate 1, formed by curing a black ceramic on the edge portion of the glass plate 1.

| | |
|---|---|
| (1) Main antenna conductor 2 | |
| Height | a = 50 mm |
| Width | b = 25 mm |
| Width of conductor strip | 1 mm |
| Number of conductor strips | 5 |
| Opening degree | $\theta_0$ = 20° |
| (2) Earth conductor 4 | |
| Width | c = 25 mm |
| Height | d = 15 mm |

-continued

| | |
|---|---|
| Angles | $\theta_1 = \theta_2 = 70°$ |
| (3) Distance from the edge of the black ceramic 35 | e = 90 mm<br>f = 10 mm |
| (4) Distance between the main antenna conductor 3 and the earth conductor 4 | g = 2 mm |

Figure 4:
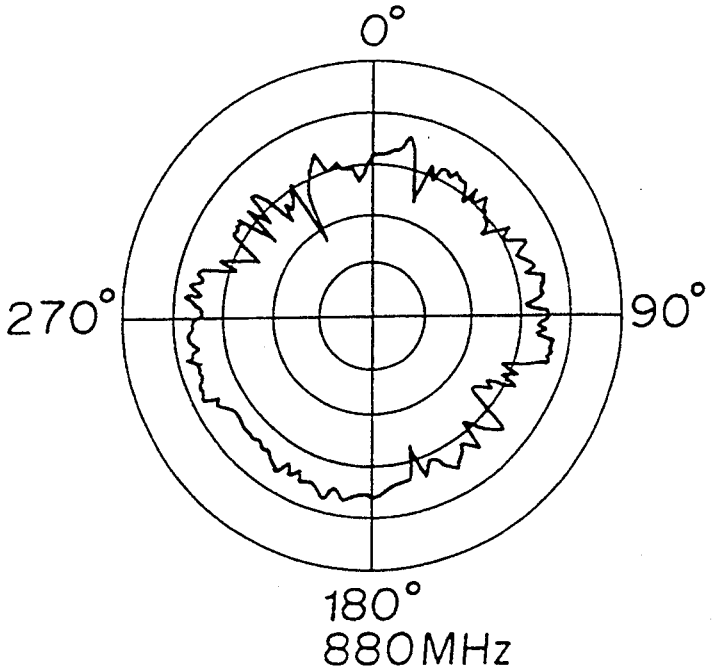
FIG. 4 is a directivity characteristic diagram of the antenna conductor in Embodiment 1, at 880 MHz.
Figure 5:
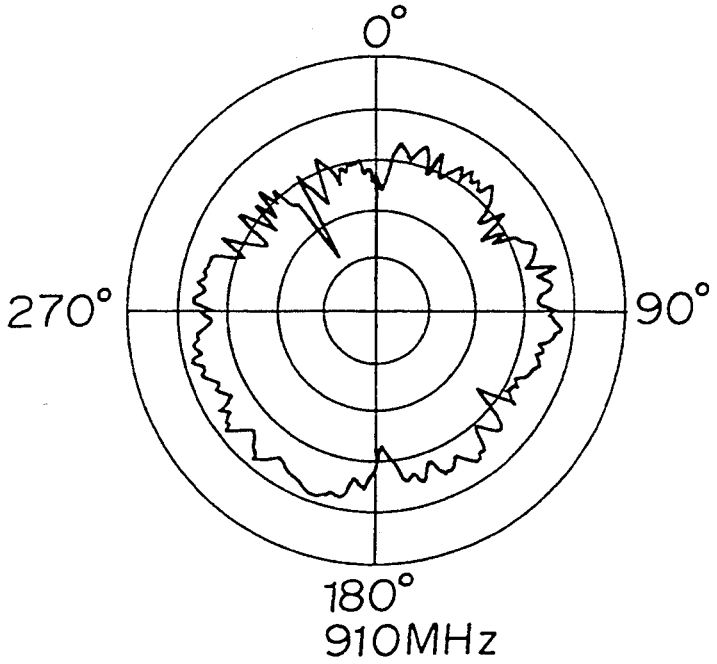
FIG. 5 is a directivity characteristic diagram of the antenna conductor in Embodiment 1, at 910 MHz.

As a result of an experiment on the above configuration, experimental data are obtained as shown in Tables 1, 2 and 3. The data shown in Tables 1, 2 and 3 show an antenna sensitivity in a vertical plane of polarization. FIGS. 4 and 5 are respectively directivity characteristics diagrams, at 880 MHz and 910 MHz.

The minimum gain, the average gain, and the maximum gain in Tables 1 to 3 are those in case that an automobile is rotated by one rotation while remaining at the same position. This data is almost equivalent with those in the conventional pole antenna, and the antenna is formed to have practically almost equivalent performance therewith.

TABLE 1

| Frequency MHz | 820 | 830 | 840 | 850 |
|---|---|---|---|---|
| Average gain | −1.4 | −1.5 | −1.6 | −1.8 |
| Minimum gain | −16.7 | −17.3 | −18.2 | −18.5 |
| Maximum gain | +15.8 | +4.7 | +4.8 | +5.2 |

(unit: dBμV)

TABLE 2

| Frequency MHz | 860 | 870 | 880 | 890 | 900 |
|---|---|---|---|---|---|
| Average gain | −2.0 | −1.5 | −1.3 | −1.0 | −0.5 |
| Minimum gain | −20.2 | −15.4 | −16.8 | −14.6 | −15.0 |
| Maximum gain | +5.3 | +5.8 | +6.2 | +7.1 | +7.3 |

(unit: dBμV)

TABLE 3

| Frequency MHz | 910 | 920 | 930 | 940 | Total average |
|---|---|---|---|---|---|
| Average gain | −0.3 | −0.2 | −0.7 | −0.8 | −1.1 |
| Minimum gain | −12.5 | −14.1 | −15.9 | −16.2 | −16.2 |
| Maximum gain | +7.2 | +6.5 | +6.8 | +6.5 | +6.1 |

(unit: dBμV)

Example 2

Figure 6:
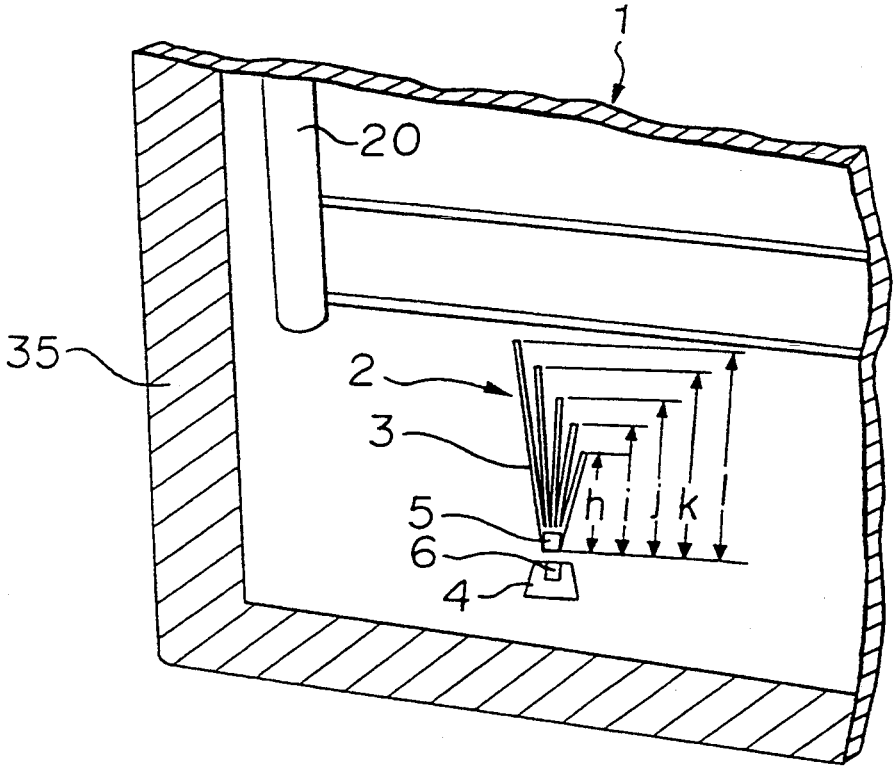
FIG. 6 is a front view of a glass plate for a rear window of an automobile showing the position of the antenna conductor in Embodiment 2.

A further embodiment of the present invention is shown in FIG. 6 in which lengths of the respective conductor strips are changed.

The respective dimensions of the conductor strips in FIG. 6 are shown below.

h=3 cm
i=5 cm
j=7 cm
k=9 cm
l=11 cm
$\theta_0$=25°

The result is shown in Tables 4 to 6. As apparent from these results, an almost flat frequency characteristic is obtained over the range of 820 to 940 MHz.

TABLE 4

| Frequency MHz | 820 | 830 | 840 | 850 | 860 |
|---|---|---|---|---|---|
| Average gain | −1.7 | −1.7 | −1.6 | −1.6 | −1.6 |
| Minimum gain | −17.5 | −16.8 | −17.2 | −17.8 | −17.4 |

TABLE 4-continued

| Frequency MHz | 820 | 830 | 840 | 850 | 860 |
|---|---|---|---|---|---|
| Maximum gain | +2.6 | +2.8 | +2.4 | +2.6 | +2.6 |

TABLE 5

| Frequency MHz | 870 | 880 | 890 | 900 | 910 |
|---|---|---|---|---|---|
| Average gain | −1.5 | −1.6 | −1.5 | −1.4 | −1.6 |
| Minimum gain | −17.4 | −16.4 | −17.0 | −17.5 | −17.5 |
| Maximum gain | +2.5 | +2.4 | +2.5 | +2.5 | +2.5 |

TABLE 6

| Frequency MHz | 920 | 930 | 940 | Average sensitivity |
|---|---|---|---|---|
| Average gain | −1.6 | −1.7 | −1.7 | −1.6 |
| Minimum gain | −17.1 | −16.7 | −17.0 | −17.2 |
| Maximum gain | +2.1 | +2.4 | +2.3 | +2.5 |

Example 3

Figure 7:
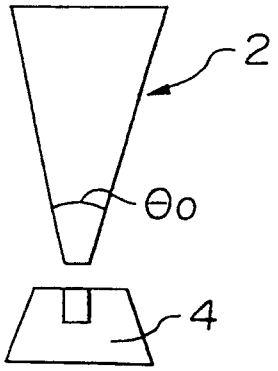
FIG. 7 is a front view of an antenna conductor in Embodiment 3.

FIG. 7 shows an antenna conductor having a planar triangular pattern instead of radial strips of the antenna conductor in FIG. 1. The pattern of FIG. 7 is a triangle having the same dimensions with the outline shape shown in FIG. 3. The receiving characteristic of the antenna is measured by the same method with that in Example 1.

The result is as the same with those in Example 1.

Furthermore, it is possible to widen the field of visibility by an antenna conductor having a planar triangular pattern or the like, made of a transparent electrically conductive film.

Figure 8:
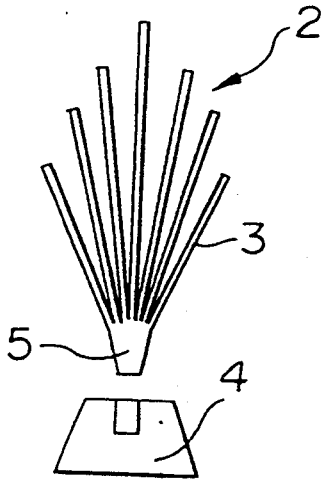
FIG. 8 is a front view showing an example of an antenna conductor wherein respective lengths of the conductor strips 3 are different.

FIG. 8 is a front view showing an Example of the antenna conductor in which the respective lengths of the respective conductor strips 3 are different. As shown in FIG. 8, even when the outline shape of the conductor strips is substantially a diamond, the same effect as the above Examples is obtained.

As mentioned above, according to the present invention, a glass antenna for a telephone of an automobile may be provided having an antenna sensitivity and antenna gain equivalent with that of the conventional pole antenna for a radiowave in the frequency band of 820 to 940 MHz. From the above effects, by dispensing with the pole antenna, a projection from the surface of an automobile is not necessary. Accordingly this invention produces an effect in which a glass antenna for a telephone of an automobile having high safety can be provided, in which a complexity in appearance thereof and unpleasant shearing sound thereof are dispensed with and a mischief is prevented.

What is claimed is:

1. A glass antenna for a telephone of an automobile which comprises:

a main antenna conductor composed of a plurality of linear conductive strips extended radially from a junction, the main antenna conductor having an overall outline shape which is substantially a triangle;

an insular earth conductor having a shape of a trapezoid which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

2. A glass antenna for a telephone of an automobile which comprises:

a main antenna conductor composed of a plurality of linear conductive strips extended radially from a junction, the main antenna conductor having an overall outline shape which is substantially a triangle;

an insular earth conductor having a shape of a trapezoid, in which an angle between a base and a side of the trapezoid is in a range of 45°–85°, which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

3. A glass antenna for a telephone of an automobile which comprises:

a main antenna conductor composed of a plurality of conductive strips having different respective lengths extended radially from a junction;

an insular earth conductor having a shape of a trapezoid which is disposed opposing the junction of the main antenna conductor and which is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

4. A glass antenna for a telephone of an automobile which comprises:

a main antenna conductor composed of a plurality of conductive strips having different respective lengths extended radially from a junction;

an insular earth conductor having a shape of a trapezoid, in which an angle between a base and a side of the trapezoid is in a range of 45°–85°, which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

5. A glass antenna for a telephone of an automobile which comprises:

a planar main antenna conductor having an overall outline shape which is substantially a triangle having a junction;

an insular earth conductive having a shape of a trapezoid which is disposed opposing the junction of the main antenna conductor and which is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

6. A glass antenna for a telephone of an automobile which comprises:

a planar main antenna conductor having an overall outline shape which is substantially a triangle having a junction;

an insular earth conductor having a shape of a trapezoid in which an angle between a base and a side of the trapezoid is in a range of 45°–85°, which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

7. A glass antenna for a telephone of an automobile which comprises:

a main antenna conductor composed of a plurality of linear conductive strips extended radially from a junction, the main antenna conductor having an overall outline shape which is substantially a sector;

an insular earth conductor having a shape of a trapezoid which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

8. The glass plate antenna for a telephone of an automobile according to claim 7, wherein in the insular earth conductor having a shape of a trapezoid, an angle between a base and a side of the trapezoid is in a range of 45°–85°.

9. A glass antenna for a telephone of an automobile which comprises:

a planar main antenna conductor having an overall outline shape which is substantially a sector having a junction;

an insular earth conductor having a shape of a trapezoid which is disposed opposing the junction of the main antenna conductor and is disconnected with the main antenna conductor with respect to direct current;

power feeding terminals provided on the main antenna conductor and the insular earth conductor; and wherein both of the main antenna conductor and the insular earth conductor are formed at predetermined positions in a glass plate.

10. A glass antenna for a telephone of an automobile according to claim 9, wherein in the insular earth conductor having a shape of a trapezoid, an angle between a base and a side of the trapezoid is in a range of 45°–85°.

* * * * *